US009131540B2

(12) United States Patent
Takahashi

(10) Patent No.: US 9,131,540 B2
(45) Date of Patent: Sep. 8, 2015

(54) IMAGE HEATING APPARATUS

(75) Inventor: Masahiro Takahashi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 800 days.

(21) Appl. No.: 13/411,913

(22) Filed: Mar. 5, 2012

(65) Prior Publication Data

US 2012/0228285 A1 Sep. 13, 2012

(30) Foreign Application Priority Data

Mar. 7, 2011 (JP) ..... 2011-048972

(51) Int. Cl.
*H05B 6/14* (2006.01)
*G03G 15/20* (2006.01)

(52) U.S. Cl.
CPC ..... *H05B 6/145* (2013.01)

(58) Field of Classification Search
CPC ..... H05B 6/145
USPC ..... 219/619, 216, 635; 399/69, 328–335
See application file for complete search history.

(56) References Cited

U.S. PATENT DOCUMENTS

2005/0067407 A1* 3/2005 Tanino et al. ..... 219/619
2010/0054786 A1* 3/2010 Hara ..... 399/69

FOREIGN PATENT DOCUMENTS

JP 2000-075699 A 3/2000
JP 2000-075700 A 3/2000
JP 2001-068263 A 3/2001
JP 2010-079268 A 4/2010

* cited by examiner

*Primary Examiner* — Quang Van
(74) *Attorney, Agent, or Firm* — Canon USA Inc IP Division

(57) ABSTRACT

A temperature detection unit is arranged in a position between a magnetic field generation coil and a magnetic core that lies inside a heat generation member. A cut portion for exposing the temperature detection unit through the magnetic core has a thickness when seen in a cross section in the direction of a magnetic flux.

4 Claims, 8 Drawing Sheets

IMAGE HEATING APPARATUS

BACKGROUND OF THE INVENTION

1. Field of the Invention

The present invention relates to an image heating apparatus of electromagnetic (magnetic) induction heating type which is mounted on a copying machine, printer, facsimile, or other image forming apparatus that forms an image by an electrophotographic process, electrostatic recording process, or magnetic recording process.

Examples of the image heating apparatus are an apparatus that fixes an unfixed image on recording material and an apparatus that heats an image fixed on recording material to increase the glossiness of the image.

2. Description of the Related Art

Some image forming apparatuses use toner powder as a developer. In the process of fixing (heating) an unfixed toner image formed and borne on recording material, such image forming apparatuses typically employ a method of nipping the recording material between an image heating member and a pressure member and heating the toner image so that the toner image is fixed onto the recording material by pressure. The image heating member and the pressure member are rotating members that are pressed against each other to form a nip portion. At least the image heating member is heated by a heating unit to a predetermined temperature. There are various types of heating units for heating an image heating member. A heating unit of electromagnetic induction heating type includes an excitation coil which is opposed to a conductive layer. The excitation coil generates a magnetic field and thereby causes magnetic fluxes in the conductive layer lying in the magnetic field. This produces eddy currents within the conductive layer to generate heat. The electromagnetic induction heating method can directly heat the image heating member, so that the image heating member can generate heat in an extremely short time.

Japanese Patent Application Laid-Open No. 2000-075699 discusses a fixing apparatus that includes a belt member, a belt guide member, a pressure roller, and an electromagnetic induction heating apparatus. The belt member is supported without tension. The belt guide member is arranged close to an inner circumferential surface of the belt member. The pressure roller is pressed against the belt member. The electromagnetic induction heating apparatus heats the belt member. The belt member corresponds to a fixing member. The pressure roller corresponds to a pressure member. A thermistor, a temperature detection unit, is arranged in contact with the inner circumferential surface of the belt member, at the rotationally downstream side of a portion where the pressure roller is pressed against.

According to Japanese Patent Application Laid-Open No. 2000-075699, the thermistor is not configured to detect the temperature of the portion opposed to a coil, i.e., the temperature of a high temperature area where heat is generated. This gives rise to a problem of slow response when the belt temperature increases abnormally. To improve response to such situations, it is desirable to detect the temperature of the heat-generating portion, i.e., the portion opposed to a coil. A temperature detection member is thus desirably arranged on the inner circumferential surface of the belt member where opposite to a coil.

On the other hand, if an image heating member is thin as a belt which is an example of the image heating member, the skin depth can exceed the thickness of a conductive layer in the belt. In such a case, magnetic fluxes leak to the inner surface of the belt. With divergent leakage fluxes, the efficiency of heat generation drops due to less concentration of magnetic fluxes on the belt. Japanese Patent Application Laid-Open No. 2000-075700 discusses a configuration in which a magnetic core is arranged inside a belt, and a thermistor or a temperature sensing unit is arranged between the magnetic core and the belt.

For improved heat generation efficiency, the distance between the image heating member and the magnetic core needs to be reduced. An Electrical wire of a temperature detection member may be laid between the image heating member and the magnetic core and lead out from inside the image heating member.

With Such a configuration, however, the electrical wire and the image heating member are prone to come into contact with each other. The image heating member rotates. If the electrical wires frequently come into contact with the image heating member, the electrical wire and the image heating member wear out easily, failing to provide long life to each of the members.

A through portion may be formed through a part of the magnetic core, and the electrical wire may be laid in an internal space of the magnetic core via the through portion. Such a configuration can reduce the frequency of contact between the electrical wire and the image heating member.

In some case, the Electrical wire may be obliquely passed through a magnetic core. If a through portion is formed across the entire area where the electrical wires pass as illustrated in FIG. 7, the large opening of the through portion on the image heating member side causes irregularities of magnetic fluxes. Avoiding the irregularities limits the location of the through portion, such as to where the effect of heat generation from the image heating member is small. This decreases the degree of freedom in design.

A through portion that can reduce flux irregularities is thus desired to avoid the limitation on the layout of the through portion.

SUMMARY OF THE INVENTION

The present invention is directed to an image heating apparatus in which uneven heating of an image heating member due to the effect of a through portion is reduced.

According to an aspect of the present invention, there is provided an image heating apparatus including: an image heating member configured to include a conductive layer that generates heat when subjected to a magnetic flux, and to heat an image on recording material; a coil arranged outside the image heating member and configured to generate a magnetic flux; a magnetic core arranged inside the image heating member; a temperature detection unit arranged in an area between an area of the image heating member opposed to the coil and the magnetic core, and configured to detect a temperature of the image heating member; a control circuit configured to control energization to the coil based on an output of the temperature detection unit; and an electrical wire laid outside the image heating member through a through portion to electrically connect the control circuit and the temperature detection unit, the magnetic core is provided with the through portion passing through the magnetic core in an area where the magnetic core is opposed to the coil with the image heating member therebetween, and the through portion is formed to have an area where an opening of the through portion on an interior side overlaps the magnetic core in a direction of a normal to the opening of the through portion on the interior side.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 2:
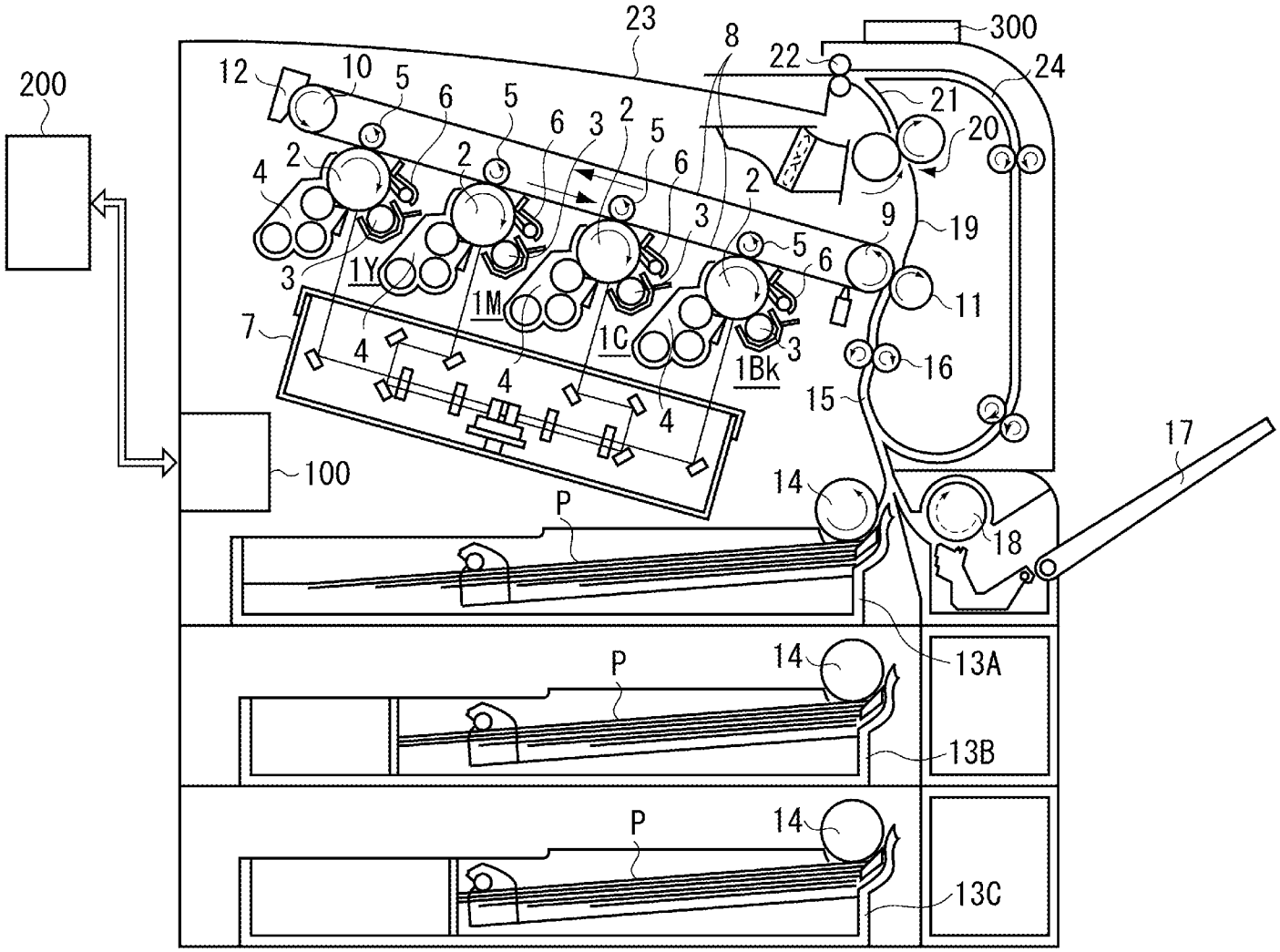
FIG. 2 is a longitudinal sectional schematic diagram illustrating a general configuration of an image forming apparatus according to the first exemplary embodiment.

A first exemplary embodiment will be described. FIG. 2 is a longitudinal sectional schematic diagram illustrating a general configuration of an electrophotographic full color printer. The electrophotographic full color printer is an example of an image forming apparatus that is equipped with a fixing apparatus 20, an image heating apparatus according to an exemplary embodiment of the present invention. Initially, image forming units will be overviewed. The electrophotographic full color printer includes a control unit (control circuit board: central processing unit (CPU)) 100 which is communicably connected with an external host apparatus 200. According to input image information from the external host apparatus 200, the electrophotographic full color printer can make an image forming operation to form a full color image on recording material P and output the resultant.

Examples of the external host apparatus 200 include a computer and an image reader. The control unit 100 includes a control circuit, and transmits and receives signals to/from the external host apparatus 200 and an operation unit 300 of the image forming apparatus. The control unit 100 also transmits and receives signals to/from various types of image forming devices and controls an image forming sequence. An endless, flexible intermediate transfer belt (hereinafter, abbreviated as belt) 8 is stretched across a secondary transfer counter roller 9 and a tension roller 10. When the secondary transfer counter roller 9 is driven, the belt 8 is driven to rotate at a predetermined speed in the arrowed counterclockwise direction.

A secondary transfer roller 11 is pressed against the foregoing secondary transfer counter roller 9 with the intermediate transfer belt 8 therebetween. The abutting portion between the intermediate transfer belt 8 and the secondary transfer roller 11 constitutes a secondary transfer unit. First to fourth, four image forming units 1Y, 1M, 1C, and 1Bk are arranged in a row under the intermediate transfer belt 8 at predetermined intervals along the moving direction of the belt 8. The image forming units 1Y, 1M, 1C, and 1Bk each are an electrophotographic process mechanism of laser exposure type. Each image forming unit 1Y, 1M, 1C, or 1Bk includes a drum-shaped electrophotographic photosensitive member (hereinafter, abbreviated as drum) 2, which serves as an image bearing member and is driven to rotate at a predetermined speed in the arrowed counterclockwise direction. Each drum 2 is surrounded by a primary charging device 3, a development device 4, a transfer unit or transfer roller 5, and a drum cleaner device 6. Each of the transfer rollers 5 is arranged inside the intermediate transfer belt 8. The transfer rollers 5 are pressed against the respective corresponding drums 2 via a lower running portion of the intermediate transfer belt 8.

The abutting portions between each of the drums 2 and the intermediate belt 8 constitute respective primary transfer units. A laser exposure device 7 is provided for the drums 2 of the image forming units 1Y, 1M, 1C, and 1Bk. The laser exposure device 7 includes a laser emitting unit, a polygonal mirror, and reflection mirrors. The laser emitting unit emits laser according to time-series electrical digital pixel signals of image information supplied thereto. The control unit 100 makes the image forming units 1Y, 1M, 1C, and 1Bk perform an image forming operation based on color separation image signals input from the external host apparatus 200. As a result, the first to fourth image forming units 1Y, 1M, 1C, and 1Bk form color toner images in yellow, magenta, cyan, and black on the surfaces of the respective rotating drums 2 at predetermined control timing.

An image forming process for forming a toner image on a drum 2 will be described. When an image input signal is input, a drum 2 rotates. The drum 2 is then charged by a primary charging device 3. The laser exposure device 7 exposes the charged drum 2 to an image, whereby an electrostatic latent image is formed on the drum 2. A development device 4 develops the electrostatic latent image formed on the drum 2, whereby a toner image is formed on the drum 2. Such an image forming process is performed on each of the image forming units 1Y, 1M, 1C, and 1Bk. The intermediate transfer belt 8 is driven to rotate in a forward direction with respect to the directions of rotation of the drums 2, at a speed corresponding to the rotation speed of the drums 2. Toner images formed on the image forming units 1Y, 1M, 1C, and 1Bk are successively transferred to an outer surface of the intermediate transfer belt 8 by the respective primary transfer units in a superimposed manner.

Consequently, the foregoing four toner images are superimposed to compose and form unfixed full color toner images on the surface of the intermediate transfer belt 8. There is provided a plurality of stages of cassette sheet feed units 13A, 13B, and 13C which accommodate a stack of sheets of recording material P of respective different widths and sizes. A feed roller 14 in a selected stage of cassette sheet feed unit 13A, 13B, or 13C is driven at predetermined feed timing. As a result, a sheet of recording material P stacked and accommodated in that stage of cassette sheet feed unit is separated, fed, and conveyed to a registration roller 16 through a vertical conveyance path 15.

If manual feed is selected, a feed roller 18 is driven. A sheet of recording material stacked and set on a manual feed tray (multipurpose tray) 17 is thereby separated, fed, and conveyed to the registration roller 16 through the vertical conveyance path 15. The registration roller 16 conveys recording material P in proper timing so that the leading edge of the recording material P reaches the secondary transfer unit in synchronization with the timing when the leading edge of the foregoing full color toner images on the rotating intermediate transfer belt 8 reaches the secondary transfer unit. The secondary transfer unit secondarily transfers in series the full color toner images on the intermediate transfer belt 8 to a surface of the recording material P collectively.

The recording material P past the secondary transfer unit is separated from the surface of the intermediate transfer belt 8 and guided by a vertical guide 19 into the fixing apparatus (fixing device) 20. The fixing apparatus 20 melts and mixes the toner images in a plurality of colors, and fixes the resultant as a fixed image on the surface of the recording material P. The recording material P past the fixing apparatus 20 is passed through a conveyance path 21 and discharged by discharge rollers 22 onto a sheet discharge tray 23 as a full color image formation product. After the separation of the recording material P in the secondary transfer unit, the surface of the intermediate transfer belt 8 is subjected to a belt cleaning device 12 for cleaning. The belt cleaning device 12 removes residual adhering substances such as secondary transfer residual toner. The cleaned surface of the intermediate transfer belt 8 is used for image formation again. If a monochrome printing mode is selected, only the fourth image forming unit 1Bk for forming a black toner image is operated and controlled for image formation.

If a two-sided printing mode is selected, first-side-printed recording material P is sent to the sheet discharge tray 23 by the discharge rollers 22. Immediately before the trailing edge of the recording material P passes the discharge rollers 22, the discharge rollers 22 are reversed in rotation. The recording material P is thereby switched back and guided into a reconveyance path 24. The recording material P turned over is conveyed to the registration roller 16 again. Subsequently, as with printing the first side, the recording material P is conveyed to the secondary transfer unit and to the fixing apparatus 20, and discharged onto the sheet discharge tray 23 as a two-sided printing image formation product.

The fixing apparatus 20 will be described. In the following description, the longitudinal direction of the fixing apparatus 20 or that of a component of the fixing apparatus 20 shall refer to a direction parallel to a direction that is orthogonal to the direction of conveyance of recording material P in the plane of a recording material conveyance path. The longitudinal direction is substantially the same as the direction of the rotation axis of a belt member 31*a* to be described later. An upstream side and a downstream side shall refer to those in the direction of rotation of the belt member 31*a* to be described later.

Figure 1:
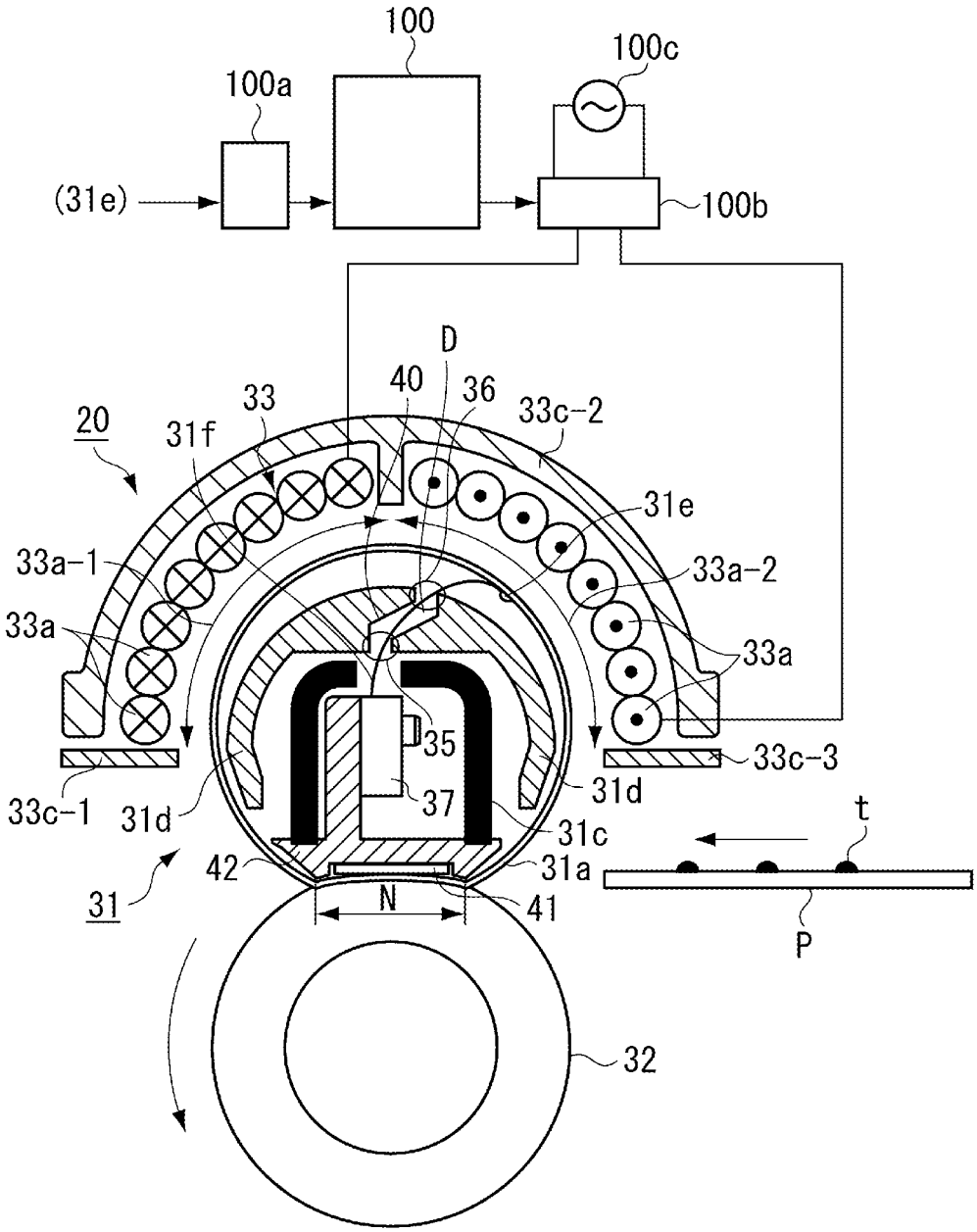
FIG. 1 is an enlarged cross-sectional schematic diagram illustrating a general configuration of a fixing apparatus according to a first exemplary embodiment.

FIG. 1 is an enlarged cross-sectional schematic diagram illustrating a general configuration of the fixing apparatus 20, the image heating apparatus according to the present exemplary embodiment. The fixing apparatus 20 includes a belt assembly 31. The belt assembly is arranged in parallel with each other with both longitudinal ends being held between opposite side plates of the device frame member (not illustrated). The belt assembly includes a belt member 31*a*, an image heating member. The fixing apparatus 20 also includes a pressure roller 32, which serves as a pressure member having elasticity as a rotatable pressure member. The fixing apparatus 20 also includes a coil unit 33, which includes a coil 33*a* and serves as a magnetic field generation unit. The belt member 31*a* and the pressure roller are pressed against each other to form a nip portion N therebetween. The nip portion N has a predetermined width in the direction of conveyance of recording material P. The coil unit 33 is arranged outside the belt member 31*a*. The coil unit 33 and the belt member 31*a* are opposed to and kept out of contact with each other at a predetermined distance.

The belt assembly 31 will be described. The belt assembly includes a cylindrical, flexible belt member 31*a* as a rotatable image heating member. The belt member 31*a* includes a conductive layer. When the conductive layer passes through an area where a magnetic field (flux) produced by the coil unit 33 is present, the conductive layer generates heat by electromagnetic induction. The belt member 31*a* heats toner images on recording material P with the heat generated by the conductive layer. The belt assembly 31 also includes a pressure pad 41 and a pressure pad holder 42 (hereinafter, abbreviated as holder). The pressure pad 41 forms the nip portion N. The holder 42 has heat resistance and rigidity and holds the pressure pad 41. The pressure pad 41 and the holder 42 are arranged inside the belt member 31*a* (inside a heat generation member). The belt assembly 31 also includes a rigid pressure stay 31*c* (hereinafter, abbreviated as stay) which is arranged over the holder 42 and inside the belt member 31*a*. The stay 31*c* is made of metal and has a U-shaped cross section. The belt assembly 31 also includes a magnetic core (magnetic shielding core) 31*d* as a magnetic shielding member. The magnetic core 31*d* is arranged outside the stay 31*c* and inside the belt member 31*a* to cover the stay 31*c*.

Figure 3:
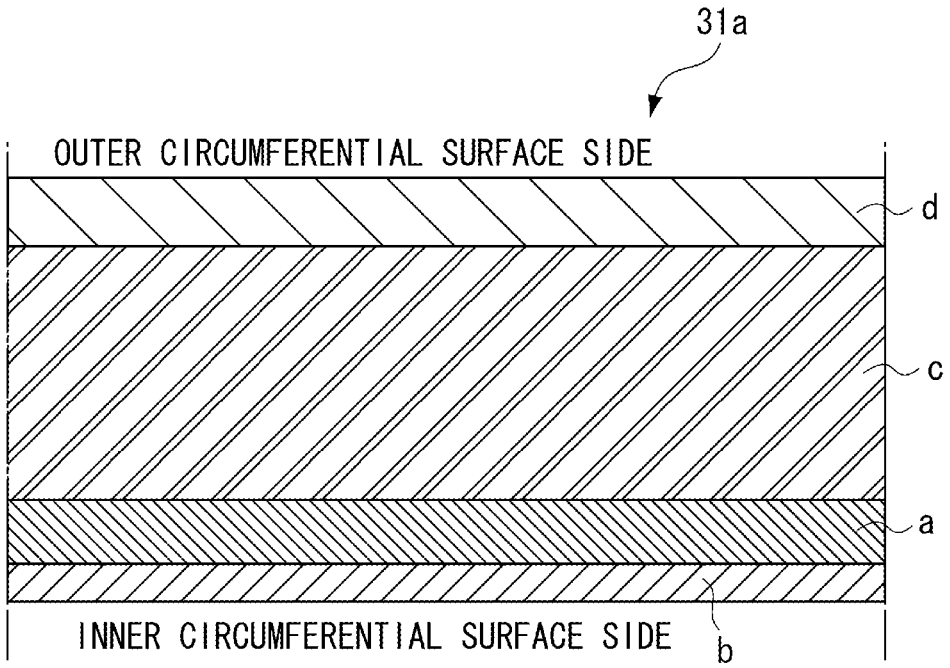
FIG. 3 is a diagram illustrating a layer configuration model of a belt member.

FIG. 3 is a diagram illustrating a layer configuration model of the belt member 31*a* according to the present exemplary embodiment. The belt member 31*a* has a composite layer configuration including the following four layers: a cylindrical base layer a; an inner surface layer b which is arranged on the inner circumferential surface of the base layer a; and an elastic layer c and a release layer d which are stacked on the outer circumferential surface of the substrate a in succession. The entire belt member 31*a* has flexibility. The base layer a is a layer of a magnetic member that generates heat by electromagnetic induction. In other words, the base layer a is a conductive layer (conductive member), or an electromagnetic induction heat generation layer that produces induced currents (eddy currents) by the action of a magnetic field from the coil unit 33 and generates heat as Joule heat. In the present exemplary embodiment, an electroformed nickel layer (electroformed Ni layer) having a diameter of 30 mm and a thickness of 50 μm is used as the base layer a. For improved quick startability, the base layer a can be thin, whereas some thickness is needed in view of the efficiency of electromagnetic induction heating. The base layer a may have a thickness of around 10 to 100 μm.

The inner surface layer b is formed to secure slidability for members that come into contact with the inner surface of the belt member 31*a*. In the present exemplary embodiment, a 15-μm-thick polyimide (PI) layer is used as the inner surface layer b. Too thick an inner surface layer b affects thermal responsiveness and quick startability of a temperature detection unit, such as a thermistor, that is arranged in contact with the inner surface of the belt member 31*a*. The inner surface layer b may have a thickness of around 10 to 100 μm. An elastic layer c as thin as possible is preferred for improved quick startability. Some thickness is needed, however, to soften the surface of the belt member 31*a* for the effect of wrapping around and melting toner. The elastic layer c may have a thickness of around 100 to 1000 μm. In the present exemplary embodiment, a rubber layer having a rubber hardness of 10° (Japanese Industrial Standard (JIS)-A), a thermal conductivity of 0.8 W/m·K, and a thickness of 400 μm is used.

The release layer d may be a perfluoro alkoxy alkane (PFA) tube or a PFA coating. A PFA coating can be formed in smaller thickness. In terms of material, a PFA coating provides a higher effect of wrapping around toner and is thus superior to a PFA tube. On the other hand, a PFA tube is superior to a PFA coating in mechanical and electrical strengths. Either of the materials may be used depending on the situation. In either case, a release layer d can be thin to transfer as much heat to recording material as possible. Considering abrasion under mechanical use, the release layer d may have a thickness of around 10 to 100 μm. In the present exemplary embodiment, a PFA tube having a thickness of 30 μm is used.

The holder 42 is a member that serves as both a support and a rotation guide for the belt member 31*a*. The belt member 31*a* is loosely fitted onto the holder 42. The holder 42 may be made of heat resistant resin. In the present exemplary embodiment, polyphenylene sulfide (PPS) is used. In the present exemplary embodiment, the holder 42 has a thickness of 3 mm.

The stay 31*c* presses the holder 42 and the pressure pad 41 and supports the magnetic core 31*d*. The stay 31*c* functions to suppress bending of the holder 42 when the belt assembly 31 and the pressure roller are pressed against each other. The stay 31*c* is mainly made of metal material. In the present exemplary embodiment, the stay 31*c* is made of stainless steel. In the present exemplary embodiment, the stay 31*c* has a U-shaped cross section in a plane orthogonal to the direction of the rotation axis of the belt member 31*a*. The stay 31*c* is hollow inside.

Figure 4:
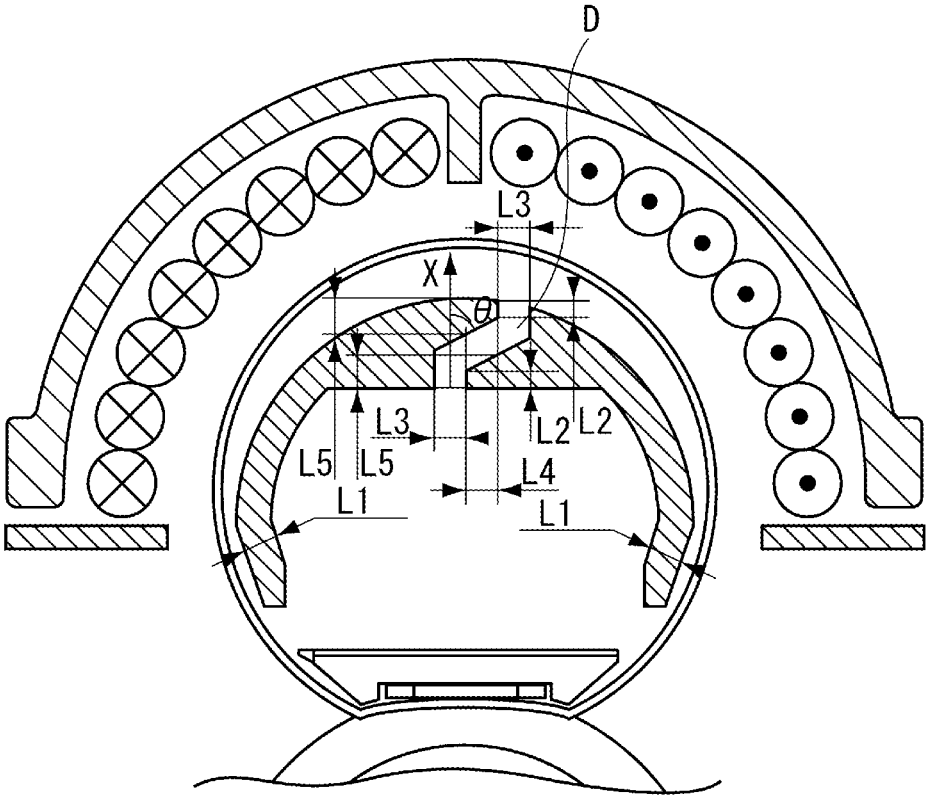
FIG. 4 is a sectional view illustrating the shape of a cut portion in a magnetic core according to the first exemplary embodiment.

The magnetic core 31*d* is arranged inside the belt member 31*a* and opposed to the coil unit 33. The magnetic core 31*d* has the function of concentrating magnetic fluxes occurring from the coil unit 33 to the interior of the belt member 31*a* (the interior of the heat generation member). The magnetic core 31*d* covers the outer surface of the stay (metal stay) 31*c*, a metal member, to shield the stay 31*c* from magnetic fluxes. The magnetic core 31*d* thereby functions to suppress warming of the stay 31*c* due to induction heating. The magnetic core 31*d* has high permeability and low loss. The magnetic core 31*d* is used to improve the efficiency of the magnetic circuit and provide magnetic shielding for the stay 31*c*. A typical example of the magnetic core 31*d* is a ferrite core. FIG. 4 illustrates dimensions of the magnetic core 31*d*. In the present exemplary embodiment, the magnetic core 31*d* has thicknesses L1=2 mm, L2=1 mm, L3=3 mm, and L4=3 mm.

A thermistor 31*e* is arranged inside the belt member 31*a*. The thermistor 31*e* is a first temperature detection member that detects a belt temperature for the sake of temperature control on the belt member 31*a*. The thermistor 31*e* is supported on the extremity of an elastic member 31*f*, whose bottom is fixed to the holder 42 or a support unit 37 of the stay 31*c*. By the springiness of the elastic member 31*f*, a temperature detection part of the thermistor 31*e* is elastically put into contact with the inner surface of the belt member 31*a*. The thermistor 31*e* makes contact with a portion of the belt member 31*a* within an image forming area, the portion being where the amount of heat generated by the coil unit 33 is the highest. In other words, the thermistor 31*e* is abutting on a portion on the inner surface of the belt member 31*a* where the amount of heat generation is the highest in the direction of belt rotation.

While the present exemplary embodiment deals with the case where the thermistor 31*e* is arranged in the portion of the highest amount of heat generation, the thermistor 31*e* need not necessarily be arranged in the portion of the highest amount of heat generation. The thermistor 31*e* may be arranged in a portion where temperature is relatively high. For that purpose, the thermistor 31*e* needs to be located at least in an area opposed to the excitation coil 33*a* via the belt member 31*a*, in a space between the magnetic core 31*d* and the belt member 31*a*. The thermistor 31*e* outputs electrical detection information on temperature (detection temperature information). The detection temperature information is input to the control unit 100 through an analog-to-digital (A/D) converter 100*a*. Based on the detection temperature information from the thermistor 31*e*, the control unit 100 controls an electromagnetic induction heating drive circuit (high frequency converter) 100*b* so that the belt temperature is maintained at a preset target temperature (image heating temperature).

More specifically, the control unit 100 controls power supply from an alternating current (AC) power supply 100*c* to the excitation coil 33*a* of the coil unit 33. If the thermistor 31*e* is used as a unit for detecting abnormal temperature of the belt member 31*a*, the control unit 100 performs the following control. Specifically, when the thermistor 31*e* remains at a preset temperature for more than a predetermined time, the control unit 100 exercises control to interrupt the power supply from the AC power supply 100*c* to the excitation coil 33*a*.

In such a case, the control unit 100 functions as an interruption unit that interrupts the power supply from the AC power source 100*c* to the excitation coil 33*a*. A thermo switch is arranged inside the belt member 31*a*. The thermo switch serves as a second temperature detection member (temperature sensing member) for detecting a belt temperature. The thermo switch senses the belt temperature.

The thermo switch is supported on the extremity of an elastic member, whose bottom is fixed to a guide member 31*b* or the magnetic core 31*d*. By the springiness of the elastic member, a temperature detection part of the thermo switch is elastically put into contact with the inner surface of the belt member 31*a*. The thermo switch makes contact with a portion of the belt member 31*a* where the amount of heat generated by the coil unit 33 is the highest. In other words, the thermo switch is in contact with a portion on the inner surface of the belt member 31*a* where the amount of heat generation is the highest in the direction of belt rotation.

While the present exemplary embodiment deals with the case where the thermo switch is arranged in the portion of the highest amount of heat generation, the thermo switch need not necessarily be arranged in the portion of the highest amount of heat generation. The thermo switch may be arranged in a portion where temperature is relatively high. For that purpose, the thermo switch needs to be located at least in an area opposed to the excitation coil 33*a* via the belt member 31*a*, in a space between the magnetic core 31*d* and the belt member 31*a*. The magnetic field generation coil (excitation coil) 33*a* of the coil unit 33 is provided with a feed line, to which the thermo switch is connected in series through thermo switch wiring. When the thermo switch detects that the temperature of the belt member 31*a* reaches or exceeds a predetermined abnormal temperature, the thermo switch interrupts power supply from the AC power supply 100*c* to the excitation coil 33*a*.

In the present exemplary embodiment, it is found that the thermo switch detection surface can make an appropriate operation if the thermo switch detection surface is abutting on a portion of the inner surface of the belt member 31*a* where temperature is as high as or higher than 80% that of the portion where temperature is the highest.

The pressure roller 32 will be described. The pressure roller 32, a pressure member, includes a core and an elastic layer. The elastic layer is made of silicon rubber, and attached to the core for the sake of reducing hardness. For improved surface properties, a fluorocarbon resin layer made of polytetrafluoroethylene (PTFE), PFA, or fluorinated ethylene propylene (FEP) may be further arranged on the outer periphery. In the present exemplary embodiment, the pressure roller 32 has an outer diameter of 30.06 mm. The core is a solid member made of stainless steel, having a radius of 8.5 mm. The elastic layer is made of silicon rubber and has a thickness of 6.5 mm.

The fluorocarbon resin layer is a PFA tube having a thickness of 30 μm. The belt assembly 31 and the pressure roller 32 are arranged in parallel. The belt assembly 31 and the pressure rollers 32 are pressed to each other by a predetermined pressing force against the elasticity of the pressure roller 32 so that the belt member 31*a* is interposed generally in the center of the holder 42 in the outer circumferential direction. As a result, a fixing nip portion N having a predetermined width in the direction of conveyance of recording material P is formed between the belt assembly 31 and the pressure roller 32Drive is transmitted from a drive unit (motor)) M to the pressure roller 32 through a drive transmission system (not illustrated), whereby the pressure roller 32 is driven to rotate at a predetermined speed in the arrowed counterclockwise direction. The rotation of the pressure roller 32 gives the belt member 31*a* a rotating force through friction between the surface of the pressure roller 32 and the surface of the belt member 31*a* in the fixing nip portion N. Consequently, the belt member 31*a* follows to rotate about the guide member 31*b* in the arrowed clockwise direction at generally the same speed as the rotation speed of the pressure roller 32 while the inner surface of the belt member 31*a* slides on in close contact with the bottom surface of the guide member 31*b* in the fixing nip portion N.

The coil unit 33 will be described. In a cross section, the coil unit 33 is curved along the outer circumferential surface of the cylindrical belt member 31*a* generally halfway around (over a range of generally 180°). The coil unit 33 is arranged in parallel with the belt member 31*a* and opposed to the belt member 31*a* with a predetermined distance from the outer surface of the belt member 31*a*. The coil unit 33 includes the magnetic field generation coil 33*a* and magnetic cores 33*c* (33*c*-1, 33*c*-2, and 33*c*-3). The magnetic field generation coil 33*a* causes induced currents in the base layer a, the magnetic member of the belt member 31*a*. The magnetic field generation coil 33*a* is connected to the electromagnetic induction heating drive circuit 100*b* for high frequency power supply of 10 to 2000 kW. In the present exemplary embodiment, the excitation coil 33*a* is made of a litz wire, a strand of a plurality of thin enameled wires which is designed to increase the conductor surface area for the sake of suppressing an increase in coil temperature. The wire is covered with a heat resistant coating.

The magnetic cores 33*c* have high permeability and low loss. The magnetic cores 33*c* are used to improve the efficiency of the magnetic circuit and provide magnetic shielding. Typical examples of the magnetic cores 33*c* are ferrite cores. In the present exemplary embodiment, the magnetic cores 33*c* include first to third, three parallel cores 33*c*-1, 33*c*-2, and 33*c*-3. The first core 33*c*-1 is located on the upstream side in the direction of rotation of the belt member 31*a* in a cross section of the coil unit 33. The third core 33*c*-3 is located on the downstream side in the direction of rotation of the belt member 31*a* in a cross section of the coil unit 33.

The second core 33*c*-2 is located in the middle of the first and third cores 33*c*-1 and 33*c*-3 so that the second core 33*c*-2 fills a space between the first and third cores. In the present exemplary embodiment, the excitation coil 33*a* is formed by winding the foregoing litz wire eight turns around a center protrusion of the second core 33*c*-2. The excitation coil 33*a* has a coil bundle portion (upstream side coil bundle portion) 33*a*-1 and a coil bundle portion (downstream side coil bundle portion) 33*a*-2. The upstream side coil bundle portion 33*a*-1 lies between the first core 33*c*-1 and the protrusion of the second core 33*c*-2. The downstream side coil bundle portion 33*a*-2 lies between the protrusion of the second core 33*c*-2 and the third core 33*c*-3. A current flows through the wires of the upstream side coil bundle portion 33*a*-1 and the wires of the downstream side coil bundle portion 33*a*-2 in respective opposite directions along the longitudinal direction of the belt member 31*a*. The first and third, two parallel cores 33*c*-1 and 33*c*-3 have the same cross-sectional dimensions, a long side L5=10 mm and a short side L6=3 mm.

A fixing operation will be described. Based on an image formation start signal, the control unit 100 turns ON the drive motor M serving as drive unit and the electromagnetic induction heating drive circuit 100*b* at least when performing image formation. With the drive motor M turned ON, the pressure roller 32 is driven to rotate, and the belt member 31*a* follows to rotate. With the electromagnetic induction heating drive circuit 100*b* turned ON, a high frequency current flows through the excitation coil 33*a*. The excitation coil 33*a* produces a magnetic field, which makes the base layer a of the belt member 31*a* generate heat by induction. The heat generation of the base layer a increases the temperature of the rotating belt member 31*a*. The thermistor 31*e* detects the temperature of the belt member 31*a*, and inputs detection temperature information to the control unit 100 through the A/D converter 100*a*.

Based on the detection temperature information from the thermistor 31*e*, the control unit 100 controls the electromagnetic induction heating drive circuit 100*b* so that the belt temperature is raised to and maintained at a preset target temperature (image heating temperature). In other words, the control unit 100 controls power supply from the AC power supply 100*c* to the excitation coil 33*a*. In such a manner, the control unit 100 drives the pressure roller 32, and starts up and controls the belt member 31*a* to the predetermined image heating temperature. Here, recording material P having unfixed toner images t thereon is guided into the fixing nip portion N with the toner image bearing surface toward the belt member 31*a*. The recording material P comes into close contact with the outer circumferential surface of the belt member 31*a* in the fixing nip portion N, and is nipped and conveyed through the fixing nip portion N along with the belt member 31*a*. Consequently, the heat of the belt member 31*a* is applied to the recording material P, along with a pressure force of the fixing nip portion N. The unfixed toner images t are thereby fixed to the surface of the recording material P by heat and pressure. The recording material P past the fixing nip portion N is separated from the outer circumferential surface of the belt member 31*a* and conveyed to outside the fixing apparatus 20.

Figure 5:
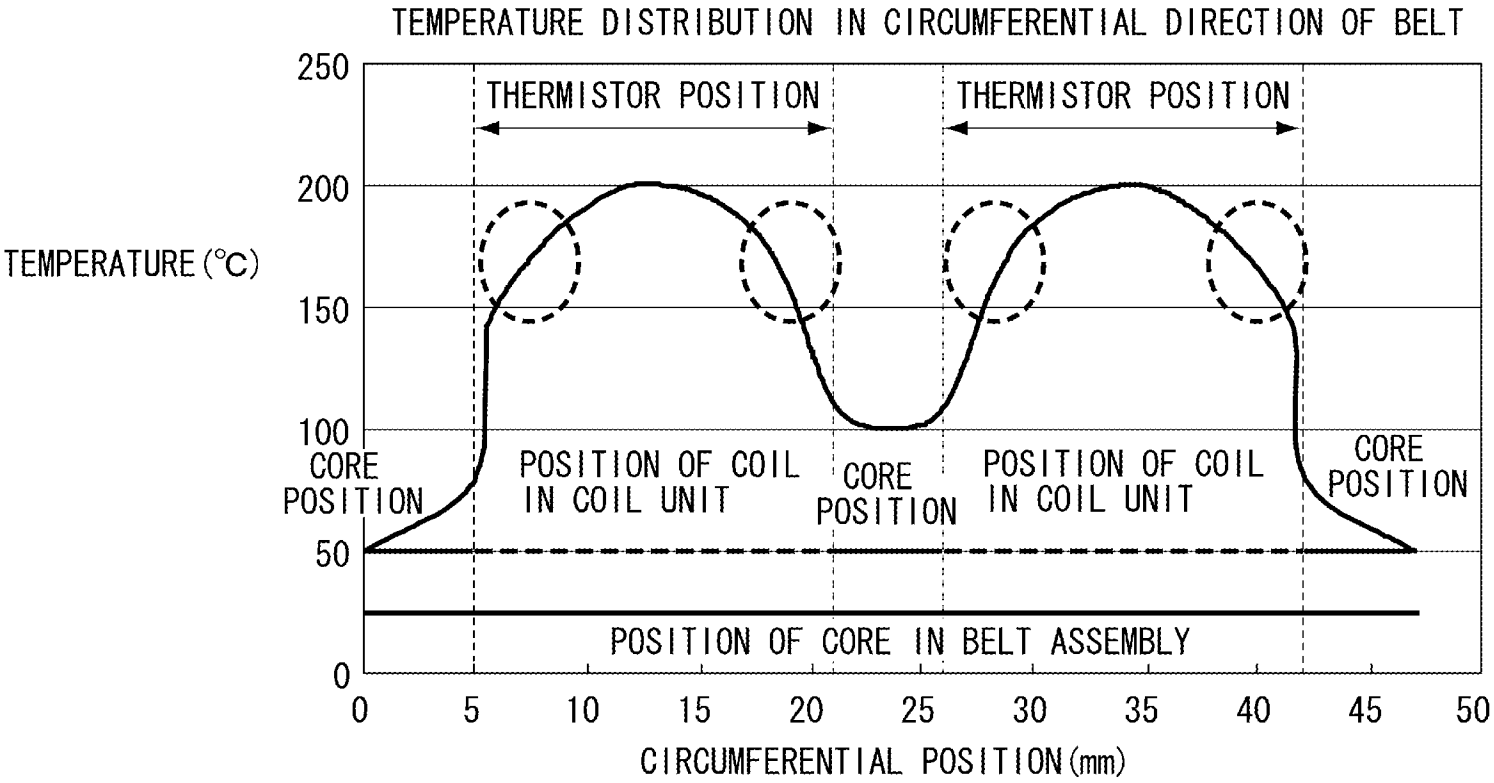
FIG. 5 is a graph illustrating a temperature distribution in a circumferential direction of a belt when the belt is stopped.

The position of a temperature detection part will be described. With the foregoing configuration, the heating of the fixing apparatus 20 was examined without rotation of the belt member 31*a*. FIG. 5 illustrates the resulting temperature distribution in the circumferential direction of the belt member 31*a*. In the fixing apparatus 20 of the present exemplary embodiment, the coil unit 33 is opposed to the belt assembly 31 so as to cover generally one half (a range of generally 180° of) the circumferential surface of the cylindrical belt member 31*a* which has a diameter of approximately 30 mm. The horizontal axis of FIG. 5 indicates the circumferential position of the belt member 31*a*. Positions A, B, and C represent the circumferential positions of the belt member 31*a* corresponding to the first core 33*c*-1, the protrusion of the second core 33*c*-2, and the third core 33*c*-3 of the coil unit 33, respectively. Position A is assumed to be 0 mm. Position B is 23.55 mm from position A in the circumferential direction of the belt member 31*a*. Position C is 47.1 mm from position A in the circumferential direction of the belt member 31*a*. In other words, the coil unit 33 covers as much as 47.1 mm of the belt member 31*a* in the circumferential direction.

As can be seen from FIG. 5, the belt temperature is low in areas corresponding to the first core 33*c*-1, the protrusion of the second core 33*c*-2, and the third core 33*c*-3 of the coil unit 33. This shows that to arrange the thermistor 31*e* in a position of higher temperature as much as possible in the belt member 31*a*, the thermistor 31*e* needs to be located in a position where the belt member 31*a* faces the excitation coil 33*a* of the coil unit 33, not a core 33*c*. The present exemplary embodiment deals with the arrangement of the thermistor 31*e*. Effects similar to those of an exemplary embodiment of the present invention can be obtained from a configuration without a thermistor. For example, similar effects can be obtained from a configuration where the temperature detection part of a temperature detection member such as a thermo switch is arranged in a similar position. Specifically, when the temperature detected by a thermo switch reaches a preset temperature higher than an image heating temperature, the control unit 100 may stop power supply to the excitation coil 33*a*, determining it to be abnormal.

The position and shape of a core cut portion will be described. In the present exemplary embodiment, a core cut portion D is formed as a through portion through an upper portion of the magnetic core 31*d* inside the belt member 31*a*.

FIG. 4 illustrates an enlarged view of the core cut portion D. The magnetic core 31*d* includes two cores that are stacked in the circumferential direction in a staggered overlapping configuration with a cut portion therebetween. A plurality of cores is arranged next to each other in the direction of the rotation axis of the belt member 31*a*. To concentrate magnetic fluxes, the distances between the magnetic cores in the direction of the rotation axis of the belt member 31*a* are set to approximately 1 mm. The magnetic cores are thereby densely arranged. In the staggered overlapping area, each magnetic core has the foregoing widths of L1=2 mm, L2=1 mm, L3=3 mm, and L4=3 mm. In FIG. 1, the core cut portion D has an opening 36 to the side of the belt member 31*a* and an opening 35 to the inner side. In the present exemplary embodiment, both the openings 35 and 36 are circular. The openings 35 and 36 are not limited to a circular shape, but may have other shapes such as rectangular.

In the present exemplary embodiment, the opening 35 and the magnetic core 31*d* overlap each other in the direction of the normal to a plane that makes the opening 35. The direction of the normal to the plane that forms the opening 35 refers to the direction of the normal to the center point of the plane. In FIG. 4, the normal direction is indicated by an arrow X. The core cut portion D has an area that runs obliquely through the magnetic core 31*d* across the normal direction, and reaches the opening 36 on the image bearing member side. In the present exemplary embodiment, the openings 35 and 36 are not positioned to overlap in the normal direction X. The configuration of the present exemplary embodiment is such that the elastic member 31*f* passes obliquely through the magnetic core 31*d*. Unlike FIG. 7, no cut portion is formed across the entire area where the elastic member 31*f* passes. Such a configuration can reduce a drop in the efficiency of heat generation since the distance between the cores across the opening 36 of the core cut portion D on the side of the belt member 31*a* can be reduced.

Specific description will be given below. In the present exemplary embodiment, the thickness of the staggered overlapping extremities of the magnetic cores, L2, is set to 1 mm. The thickness of the L5 portions respectively opposed to the staggered overlapping L2-thick extremities is set to 2 mm. Such settings are intended so that the non-overlapping L3 portions have a thickness at least equivalent to or greater than L1 in a cross section in the direction of a magnetic flux. This can provide a thickness equivalent to or greater than L1 in a cross section in the direction of magnetic fluxes across the entire area of the magnetic core 31*d*. Since the core cut portion D has such a cut shape, the magnetic core 31*d* is ensured to have a thickness greater than or equal to a necessary thickness in the direction of travel of magnetic fluxes. This enables suppression of divergence of magnetic fluxes. As a result, it is possible to reduce a drop in the efficiency of heat generation of the belt member 31*a* and to expose the thermistor 31*e* from inside the magnetic core 31*d* to an arbitrary position of the belt ember 31 through the core cut portion D.

In the present exemplary embodiment, the magnetic core 31*d* has a slope 40 oblique to the normal direction. The slope 40 is opposed to the opening 35. In the present exemplary embodiment, as illustrated in FIG. 4, the normal and the slope 40 form an angle θ of 60° therebetween. θ may range from 45° inclusive to 90° exclusive.

Figure 7:
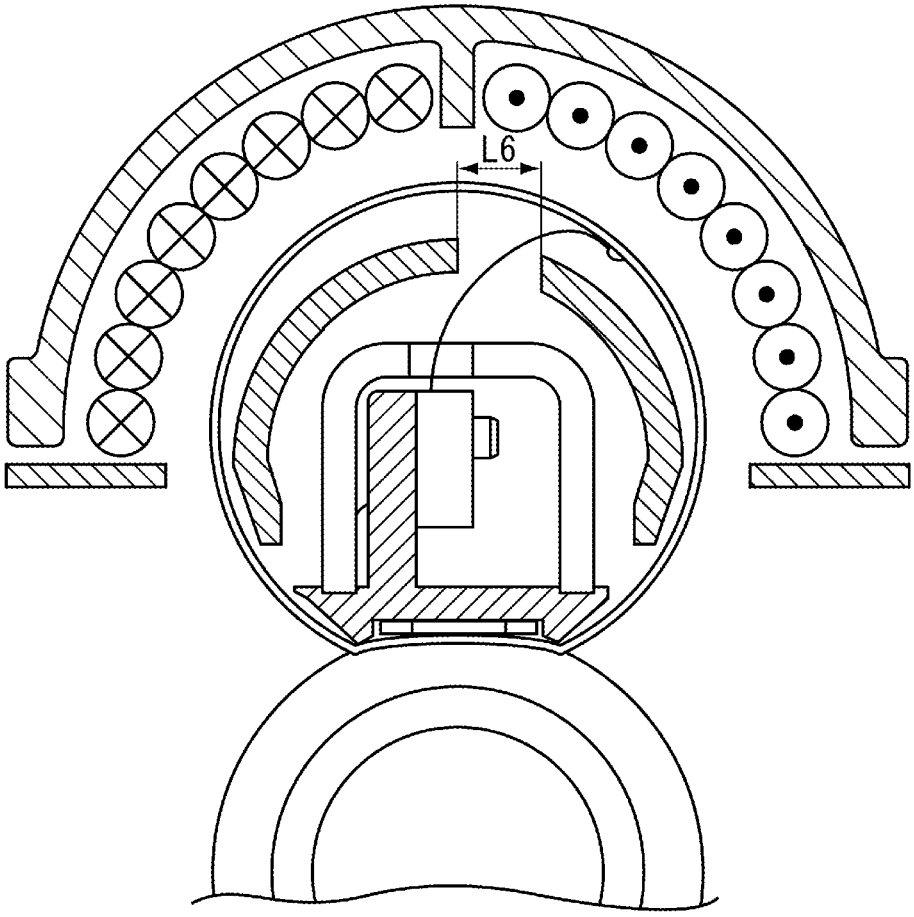
FIG. 7 is a sectional view illustrating the shape of a cut portion in a conventional magnetic core.
Figure 8:
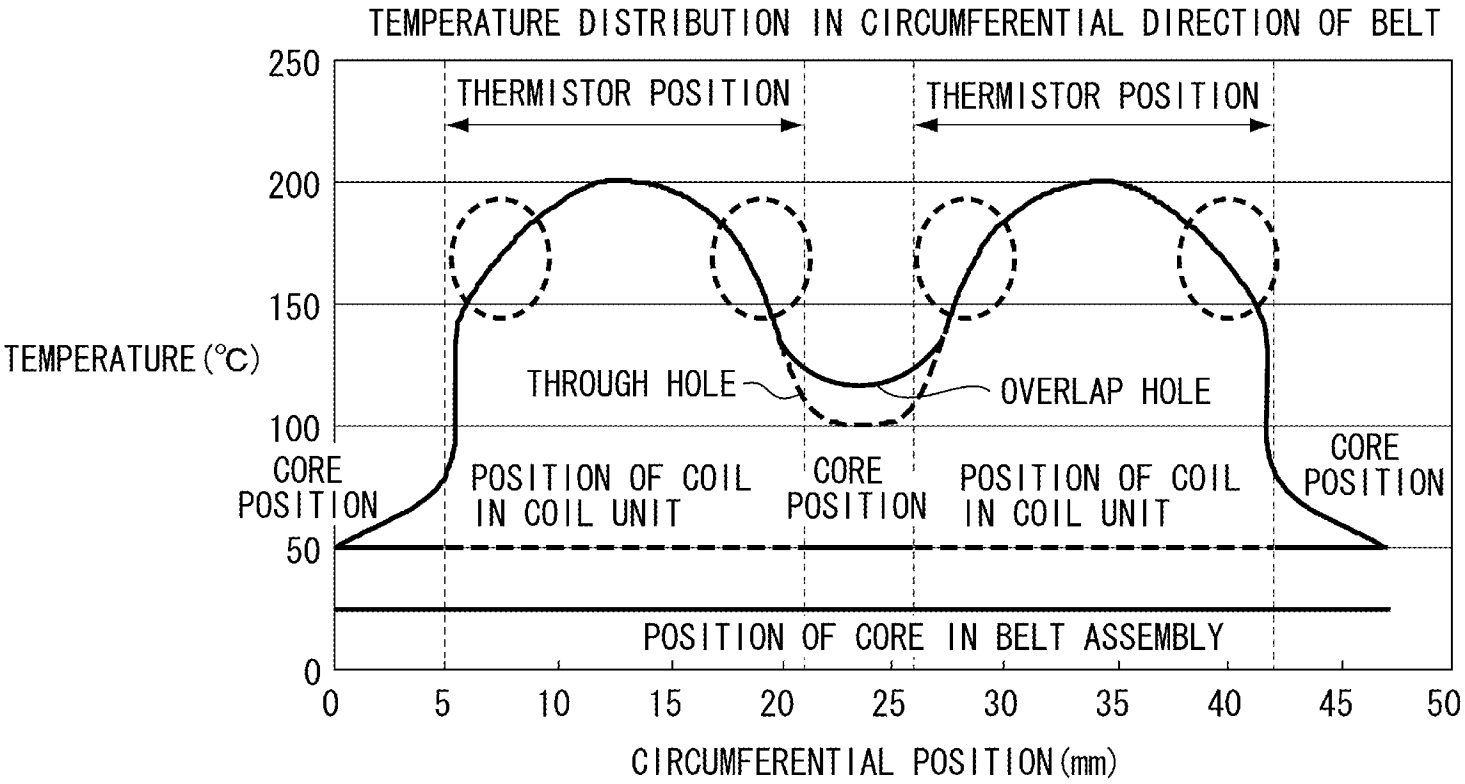
FIG. 8 is a graph for comparing temperature distributions in the circumferential direction of a belt between the cut portion in the conventional magnetic core and the cut portion in the magnetic core according to the first exemplary embodiment.

FIG. 7 is an enlarged view illustrating a thermistor-exposing cut portion when a staggered overlapping cut portion is not employed. According to the conventional method, the thermistor-exposing cut portion L6 illustrated in FIG. 7 is set to 8 mm. FIG. 8 illustrates comparison between the foregoing resulting temperature distribution in the circumferential direction of the belt member 31*a* and a temperature distribution in the circumferential direction of the belt member 31*a* with a staggered overlapping cut portion D according to the present exemplary embodiment. As can be seen from FIG. 8, the staggered overlapping cut portion D suppresses the divergence of magnetic fluxes and improves the efficiency of heat generation as compared to when a hole is simply formed.

Figure 6:
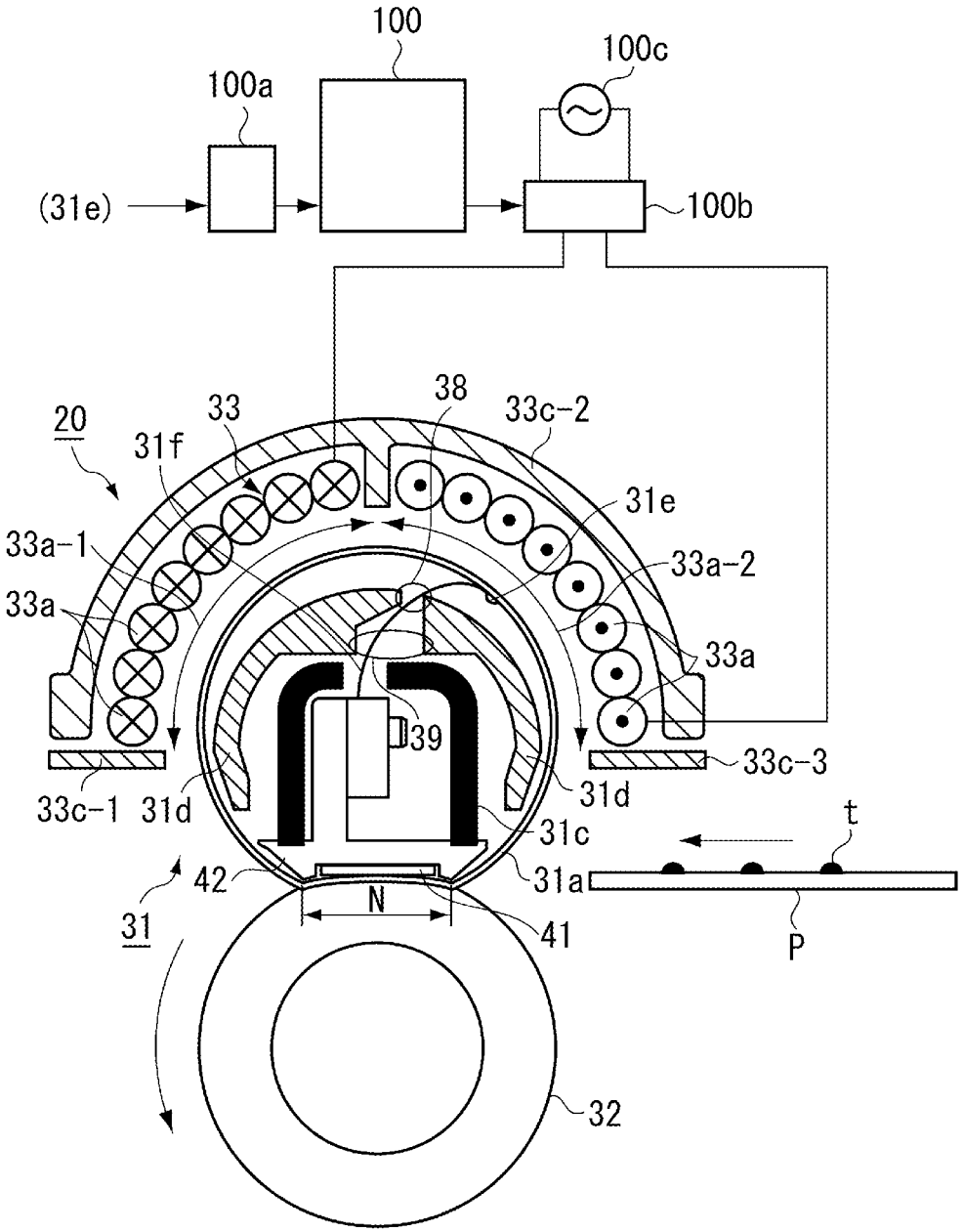
FIG. 6 is a sectional view illustrating the shape of a cut portion in a magnetic core according to a modification.

In the foregoing configuration, the overlapping magnetic cores have similar shapes. FIG. 6 illustrates another configuration where the distance between the magnetic cores across the opening 36 on the side of the belt member 31*a* can be reduced. Even with such a configuration, it is possible to suppress a drop in the efficiency of heat generation. In FIG. 6, an opening 39 on the inner side of the magnetic core 31*d* is formed to be greater than an opening 38 on the belt member side of the magnetic core 31*d*. Even in this configuration, the elastic member 31*f* passes obliquely through the magnetic core 31*d*, and a part of the opening 39 and the magnetic core 31*d* overlap in the direction of the normal to the opening 39.

Specifically, the magnetic core lying over the opening 39 has a sloped shape. The sloped shape can reduce interference of the magnetic core with elastic deformation of the elastic member 31*f* despite the configuration that the elastic member 31*f* passes through the magnetic core 31*d*.

As described above, according to the configuration of the present exemplary embodiment, it is possible to reduce irregularities of magnetic fluxes due to a through portion that is formed in the magnetic core 31*d* arranged inside the image heating member. The exemplary embodiment of the present invention has been described so far. However, the present invention is by no means limited to the foregoing exemplary embodiment, and any modifications may be made within the scope of the technical concept of an exemplary embodiment of the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-048972 filed Mar. 7, 2011, which is hereby incorporated by reference herein in its entirety.

What is claimed is:

1. An image heating apparatus comprising:

an image heating member configured to include a conductive layer that generates heat when subjected to a magnetic flux, and to heat an image on recording material;

a coil arranged outside the image heating member and generating the magnetic flux;

a magnetic core arranged inside the image heating member;

a temperature detection unit configured to be arranged in an area between an area of the image heating member opposed to the coil and the magnetic core, and to detect a temperature of the image heating member;

a control circuit configured to control energization to the coil based on an output of the temperature detection unit; and wherein the magnetic core is provided with a through portion through which an electrical wire for electrically connecting the control circuit and the temperature detection unit is passed in an area where the magnetic core is opposed to the coil with the image heating member therebetween, wherein the through portion is formed to have an area where an opening of the through portion on an interior side overlaps the magnetic core in a direction of a normal to the opening of the through portion on the interior side.

2. The image heating apparatus according to claim 1, wherein the through portion includes an area that passes through the magnetic core in a direction oblique to the direction of the normal.

3. The image heating apparatus according to claim 1, wherein the opening of the through portion on the interior side has a size greater than that of an opening of the through portion on a side of the image heating member.

4. The image heating apparatus according to claim 1, further comprising:

an elastic member configured to elastically support the temperature detection unit; and a support unit configured to be arranged on an interior side of the magnetic core and support the elastic member, wherein the elastic member is arranged through the through portion.

* * * * *